US005327151A

United States Patent [19]

Egashira

[11] Patent Number: 5,327,151

[45] Date of Patent: Jul. 5, 1994

[54] BROAD-BAND NON-GROUNDED TYPE ULTRASHORT-WAVE ANTENNA

[75] Inventor: Yoshimi Egashira, Tokyo, Japan

[73] Assignee: Harada Kogyo Kabushiki Kaisha, Tokyo, Japan

[21] Appl. No.: 905,266

[22] Filed: Jun. 26, 1992

[30] Foreign Application Priority Data

Jun. 27, 1991 [JP] Japan ..... 3-156855

[51] Int. Cl.[5] ..... H01Q 1/50; H01Q 9/32

[52] U.S. Cl. ..... 343/830; 343/715; 343/860

[58] Field of Search ..... 343/713, 715, 860–864, 343/829, 830; H01Q 1/32, 9/32, 9/38, 1/50

[56] References Cited

U.S. PATENT DOCUMENTS 4,929,961 5/1990 Nakase ..... 343/715

*Primary Examiner*—Michael C. Wimer

*Attorney, Agent, or Firm*—Koda and Androlia

[57] ABSTRACT

In order to provide a broad-band non-grounded type ultrashort-wave antenna which has sufficiently high sensitivity characteristics and broad-band VSWR characteristics even in an expanded frequency band, is able to use a small-diameter antenna element, is light in weight and simple in structure, and can be manufactured inexpensively, an antenna element parallel resonance part, that is formed by the inductance and distributed capacitance of the rod-form antenna element which has an electrical length close to lambda/2 or an integral multiple of lambda/2, and a metal member parallel resonance part, that is formed by the electrostatic capacitance between first and second metal members which are installed parallel to each other and have respective electrical lengths of lambda/4 and the inductance of the first metal member, are electrostatically coupled by the stray capacity that exists between the antenna element and an electrostatic coupling piece projected from the second metal member, thus forming a double-tuned circuit. The antenna thus constructed has the VSWR characteristics of a twin-peak form, thus being suitable for a broader frequency trend and having a desired gain for the entire frequency band used.

2 Claims, 6 Drawing Sheets

BROAD-BAND NON-GROUNDED TYPE ULTRASHORT-WAVE ANTENNA

BACKGROUND OF THE INVENTION

1. Field of the Invention

The present invention relates to a broad-band non-grounded type ultrashort-wave antenna which is desirable as, for example, a wireless telephone antenna used in an automobile telephone system, etc.

2. Prior Art

In recent years, there has been a rapid expansion in the development and utilization of the so-called "mobile communication systems" such as automobile wireless telephone systems, and even more recently, there has been a technological shift toward a high degree of digitalization. As for the frequency band used in automobile wireless telephone systems, new frequency bands have been added to both ends of the currently used frequency band in order to achieve a wider diffusion of digital systems while using such digital systems along the conventional analog systems.

At NTT (Nippon Telegram and Telephone Corporation in Japan), for example, a band that extends from 865 MHz to 945 MHz (i.e., a band with a width of 80 MHz) was used in the past; but with a rapid development of digitalization, this has been changed to a band width of 810 MHz to 960 MHz (i.e., a band with a width of 150 MHz). In other words, the band width presently used is approximately twice the conventional band width.

One of the antennas used in the past has an electrical length set at lambda/2 ($\lambda/2$), and another uses a so-called "constant-K filter." These antennas have satisfactory sensitivity characteristics and impedance characteristics (especially the VSWR characteristics), both required for mobile communications for the conventional 80 MHz band width. However, with respect to the new band width of 150 MHz which is approximately double the old band width as described above, the conventional antenna is unsatisfactory for either one or both of the sensitivity and impedance characteristics (especially the VSWR characteristics).

More specifically, in the antenna which has an electrical length of lambda/2, the sensitivity characteristics are good, but the impedance characteristics, especially the VSWR characteristics, are more or less unsatisfactory. On the other hand, in the antenna which uses the constant K filter, the impedance characteristics, especially the VSWR characteristics, are more or less good but the sensitivity characteristics are unsatisfactory.

As seen from the above, though the band width of the frequency band used for automobile wireless telephone systems has been approximately doubled due to the digitalized communications systems, the conventional antennas cannot satisfy the sensitivity characteristics nor the impedance characteristics, especially the VSWR characteristics.

One way to improve the VSWR characteristics or to achieve the broad band characteristics is to enlarge the diameter of the antenna element so as to reduce the inductance of the antenna element and to increase the capacitance, thus lowering the Q value of the antenna. However, in the automobile antennas, the wind pressure resistance increases as the diameter of the antenna element becomes larger. Accordingly, to increase the antenna diameter is not desirable from the design standpoint. Thus, there are inherent limits in the effort to increase the diameter of the antenna elements.

Another method to achieve the broad band characteristics is to incorporate lambda/4 matching devices into a multiple number of stages of the antenna element. This method, however, requires that the antenna itself be made to have broad band characteristics. Ordinarily, therefore, broad band characteristics are realized by a combination of a use of lambda/4 matching devices and a use of enlarged diameter antenna elements. However, in this combination, the structure tends to be complex and a high degree of technical skill is required to build the antenna. Furthermore, the cost of the antenna rises and the weight of the antenna increases.

SUMMARY OF THE INVENTION

Accordingly, the object of the present invention is to provide a broad-band non-grounded type ultrashort-wave antenna which has sufficiently high sensitivity characteristics and broad-band VSWR characteristics in the expanded band width, which uses a small-diameter antenna element having a diameter of, for example, approximately 2 mm, which is light in weight and simple in structure, and which can be manufactured at low cost.

In order to solve the problems and achieve the object, the present invention has a unique structure which includes: a rod-form antenna element which has an electrical length that is close to lambda/2 or an integral multiple of lambda/2, in which lambda is the wavelength of the electromagnetic waves in the frequency band used; a first metal member which has a long, slender shape and is connected to the base of antenna element, the connection of the first metal member and the antenna base being made near the tip end of the first metal member; a second metal member which has an electrical length of, for example, lambda/4 and is installed parallel to the first metal member with a prescribed gap in between and grounded, a base end of the second metal member being connected to the base end of the first metal member; a feeder line of which one end is connected to the first metal member in the vicinity of a point where the first metal member is connected to the second metal member; and an electrostatic coupling piece which projects from the tip end of the second metal men, her so that a stray capacity is created between the electrostatic coupling piece and the antenna element.

Accordingly, an antenna element parallel resonance part formed by the inductance and distributed capacitance of the antenna element, and a metal member parallel resonance part formed by the inductance of the first metal men, her and the electrostatic capacitance between the first and second metal members, are electrostatically coupled by the stray capacity which is present between the electrostatic coupling piece and the antenna element, so that a double-tuned circuit can be formed.

In the above structure, it is desirable to install a changing means which changes the size of the area of the electrostatic coupling piece relative to the antenna element, such a changing means being, for example, a sliding system.

The following effects are obtained from the above-described structure:

The antenna element parallel resonance part (formed by the inductance and distributed capacitance of the antenna element) and the metal member parallel resonance part (formed by the inductance of the first metal member and the electrostatic capacitance between the first and second metal members) are electrostatically coupled by the stray capacity which is present between the electrostatic coupling piece, that projects from the second metal member, and the antenna element. As a result, a double-tuned circuit is formed, and the VSWR characteristics of the antenna show twin-peak characteristics. Furthermore, the strength of the electrostatic coupling is changeable by altering the size of the surface area of the electrostatic coupling piece relative to the antenna element. Accordingly, the condition of the twin-peak characteristics can be altered to any desired state. Moreover, even in the expanded frequency band width, the VSWR characteristics that show a value that is sufficiently lower than the prescribed maximum value can be obtained for the entire expanded frequency band. Thus, a broad band operation is achievable.

Furthermore, a realization of a broader band can be accomplished with the length of the antenna element kept at a predetermined fixed value. In other words, the realization of a broader band can be accomplished without shortening the length of the antenna element. As a result, the antenna gain exceeds a predetermined minimum level for the entire frequency band, and sufficiently high sensitivity characteristics is obtained.

Moreover, since the metal member parallel resonance part resonates in parallel with the frequency band used, the antenna element can have a high impedance, and a non-grounded type antenna is realized. Furthermore, since the feeder line is connected to the first metal member and such a connection is made at a point where the first and second metal members are connected, an impedance matching between the antenna element and the feeder line is accomplished easily by setting the connecting point of the first and second metal members or by setting the connecting point of the core wire of the feeder line to be connected to the first metal member at a desired position, respectively.

BRIEF DESCRIPTION OF THE DRAWINGS

FIG. 1(*b*) is a side view thereof;

FIG. 2(*b*) is a graph showing the antenna element characteristics of the antenna of the present invention;

FIG. 3(*b*) is an equivalent circuit diagram of the antenna of the present invention;

FIG. 4(*b*) is a graph which compares data concerning the VSWR characteristics of the antenna of the present invention and conventional antennas;

FIG. 6(*b*) is a diagram which shows the vertical-plane radiation pattern of the antenna of the present invention at a frequency of 960 MHz;

FIG. 7(*b*) is a diagram which shows the horizontal-plane pattern of the antenna of the present invention at a frequency of 960 MHz.

DETAILED DESCRIPTION OF THE INVENTION

Figure 1A:
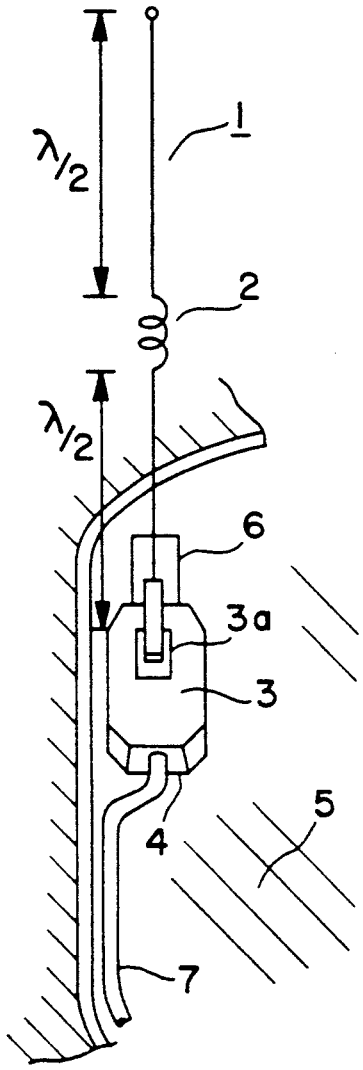
FIG. 1(*a*) is a schematic front view of the construction of the broad-band non-grounded type ultrashort-wave antenna according to the present invention.
Figure 1B:
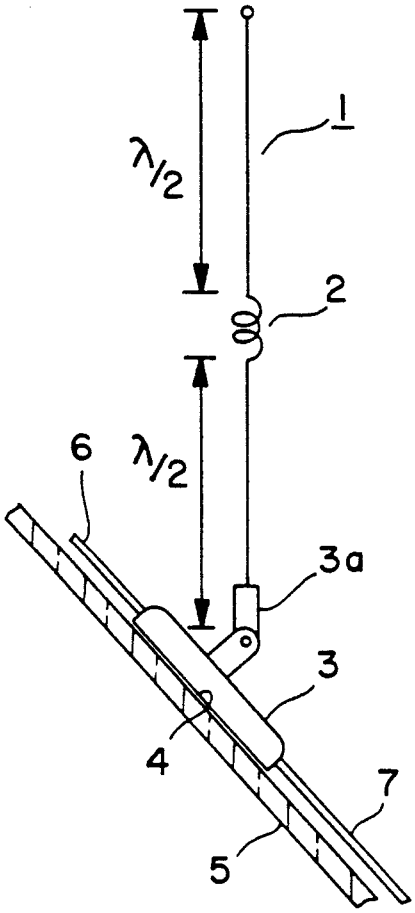

FIG. 1(*a*) shows the antenna of the present invention mounted on the outside surface of a rear windshield of an automobile, and FIG. 1(*b*) is a side view thereof.

In FIGS. 1(*a*) and 1(*b*), a rod-form antenna element 1 has an electrical length of approximately lambda/2 or an integral multiple of a lambda/2 (two times the lambda/2 length in this embodiment), where lambda (λ) is the wavelength of the electromagnetic waves in the frequency band used. The antenna element 1 of the present embodiment has a phasing coil 2 at the intermediate point, thus forming a two-stage co-linear antenna element (lambda/2 element×2). The base of the antenna element 1 is connected to antenna mount 3*a* of a casing 3 so that the supporting angle of the antenna element 1 can be changed. The casing 3 is bonded to the outside surface of the rear windshield 5 of the automobile via an adhesive sheet 4. An electrostatic coupling piece 6, which will be described later, projects from the top end of the casing 3. A feeder line 7 is led out of the bottom of the casing 3.

Figure 2A:
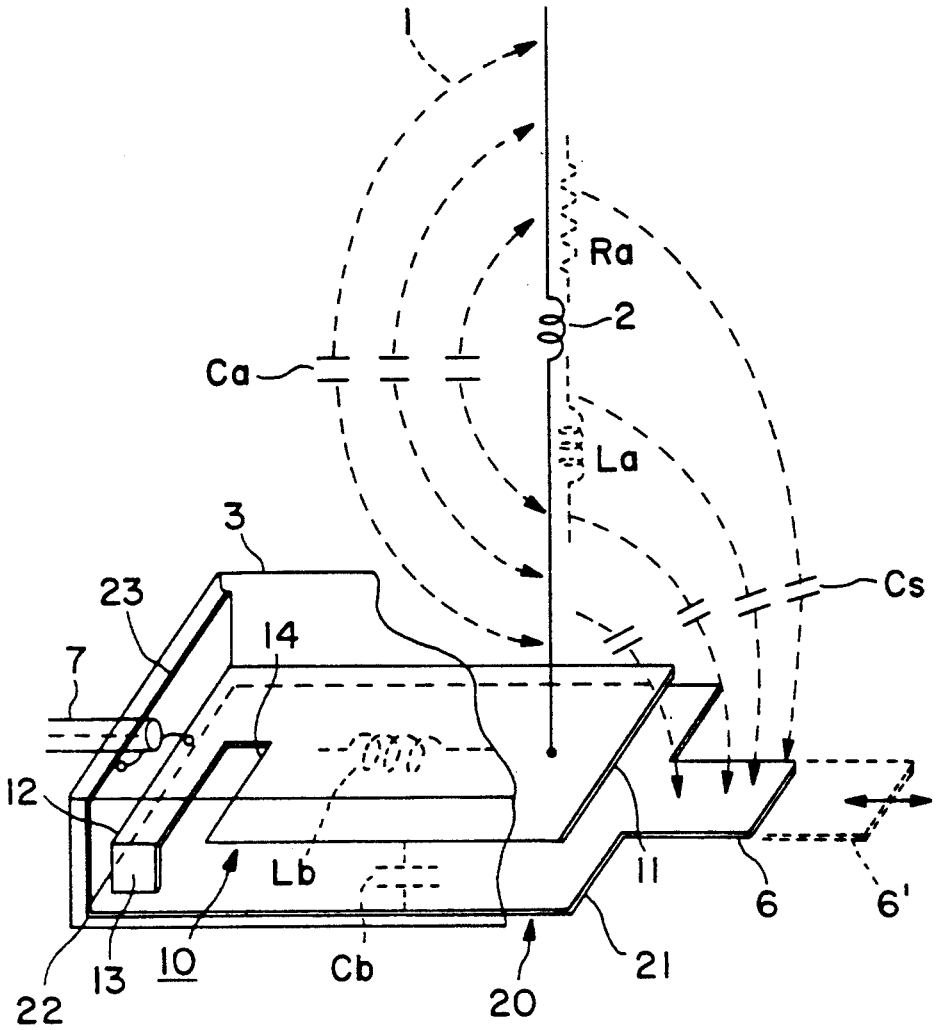
FIG. 2(*a*) shows in detail the construction of the broad-band non-grounded type ultrashort-wave antenna of the present invention.
Figure 2B:
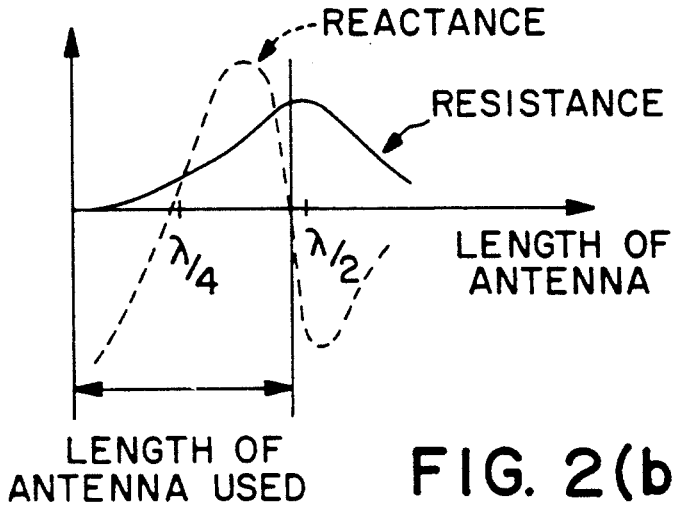

FIG. 2(*a*) is a cut-away view showing the interior of the antenna of the present invention. The electrical length of the antenna element 1 is lambda/2 (λ/2). First and second metal members 10 and 20 are installed in the casing 3 so that they are parallel to each other with a gap of several nun kept in between.

The first metal member 10 has a long, slender shape, and at a point near the tip end 11 of the metal men%her 10, the base of the antenna element 1 is connected. The other end of the first metal member 10 extends in the direction perpendicular to the axis of the antenna element 1, and a connecting section 13 is formed by bending the extended end (i.e., the base end 12) of the first metal member 10 into an L shape so that the connecting section 13 is connected to the base end 22 of the second metal member 20. A cut-out 14 formed near the base end 12 of the first metal member 10 provides the first metal member 10 with a required inductance Lb.

The second metal member 20 includes a main portion 21 which has an electrical length of lambda/4 (λ/4), thus being an equivalent to a ground wire of a Brown antenna. An L-shaped bent section 23 is formed on the base end 22 of the second metal member 20, and a feeder line 7 is connected to this bent section 23.

More specifically, the feeder line 7 is a coaxial cable, and its core wire is connected to the first metal member 10, and the outer conductor is connected to the bent section 23 of the second metal member 20. The connection between the core wire of the feeder line 7, and the first metal member 10 is made at the vicinity of the connection point between the first and second metal members 10 and 20.

In order to match the input impedance of the antenna to 50 ohms, it is only necessary to change the position where the connecting section 13 of the first metal member 10 is connected to the second metal member 20. The 50 ohm input impedance matching is also accomplished by changing the position where the core wire of the feeder line 7 is connected to the first metal member 10. In this way, the impedance matching between the antenna element 1 and the feeder line 7 is accomplished relatively easily.

As shown in FIG. 2(*a*), the first metal member 10 has inductance Lb, and there is an electrostatic capacitance Cb between the first and second metal members 10 and 20.

The electrostatic coupling piece 6, which is in a form of an oblong plate, projects from the tip end 21 of the second metal member 20. Preferably, the electrostatic coupling piece 6 is variable in its surface area. The surface area of the electrostatic coupling piece 6 can be changed by using, for example, a slide type extending and retracting mechanism as indicated by the arrows in FIG. 2(*a*).

With the use of the projecting electrostatic coupling piece 6, there is a stray capacity Cs between the coupling piece 6 and the antenna element 1.

Figure 3A:
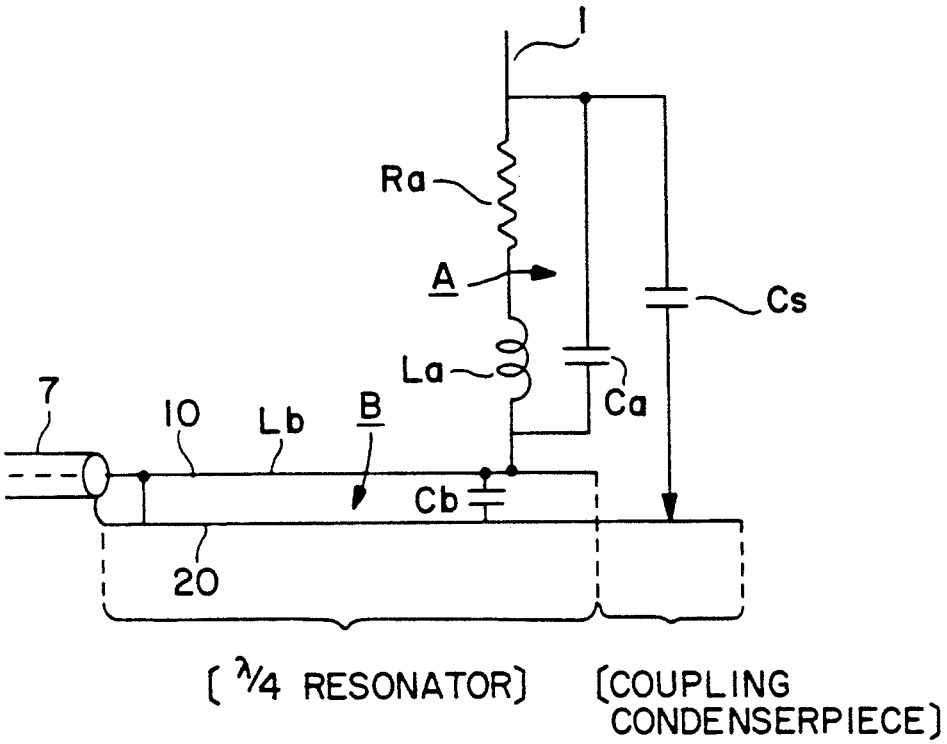
FIG. 3(*a*) is an electrical circuit diagram of the antenna of the present invention.
Figure 3B:
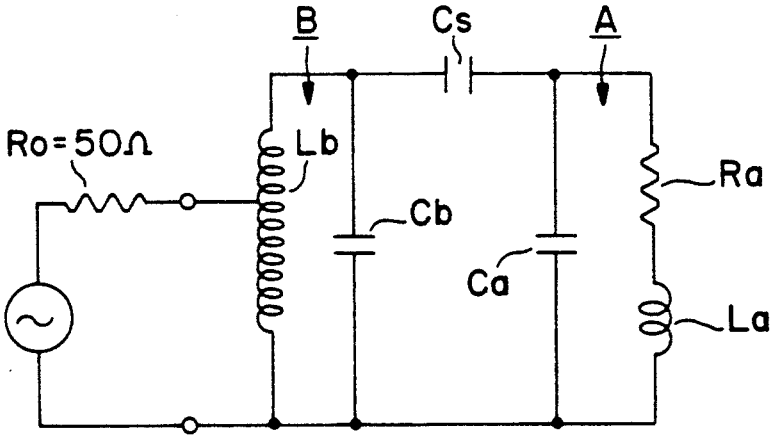

FIG. 3(*a*) is a diagram of the electrical circuit of the antenna of the present invention, and FIG. 3(*b*) shows an equivalent circuit of the same.

The antenna of the present invention has an antenna element parallel resonance part A in which a distributed capacitance Ca is connected in parallel to a series circuit. The series circuit consists of the resistance Ra and the inductance La of the antenna element 1. In addition, the electrostatic capacitance Cb, which is between the first and second metal members 10 and 20, and the inductance Lb of the first metal member 10 form a metal member parallel resonance part B (that is, a lambda/4 resonator) that resonate parallel with the frequency band used. Thus, a non-grounded type antenna is realized.

In addition, the antenna element parallel resonance part A and the metal member parallel resonance part B are electrostatically coupled by the stray capacity Cs, which realizes the antenna that has a double-tuned circuit consisting of the parallel resonance parts A and B.

The antenna of the present invention has the parallel resonance part A as described above. Accordingly, when the length of the antenna element is lambda/2 as shown in FIG. 2(*b*), the resistance reaches the maximum value, and the reactance shifts abruptly from inductive to capacitive. The reason that the reactance is zero at respective points slightly short of lambda/4 and lambda/2 in FIG. 2(*b*) is that a contraction factor can affect the actual antenna.

Figure 4A:
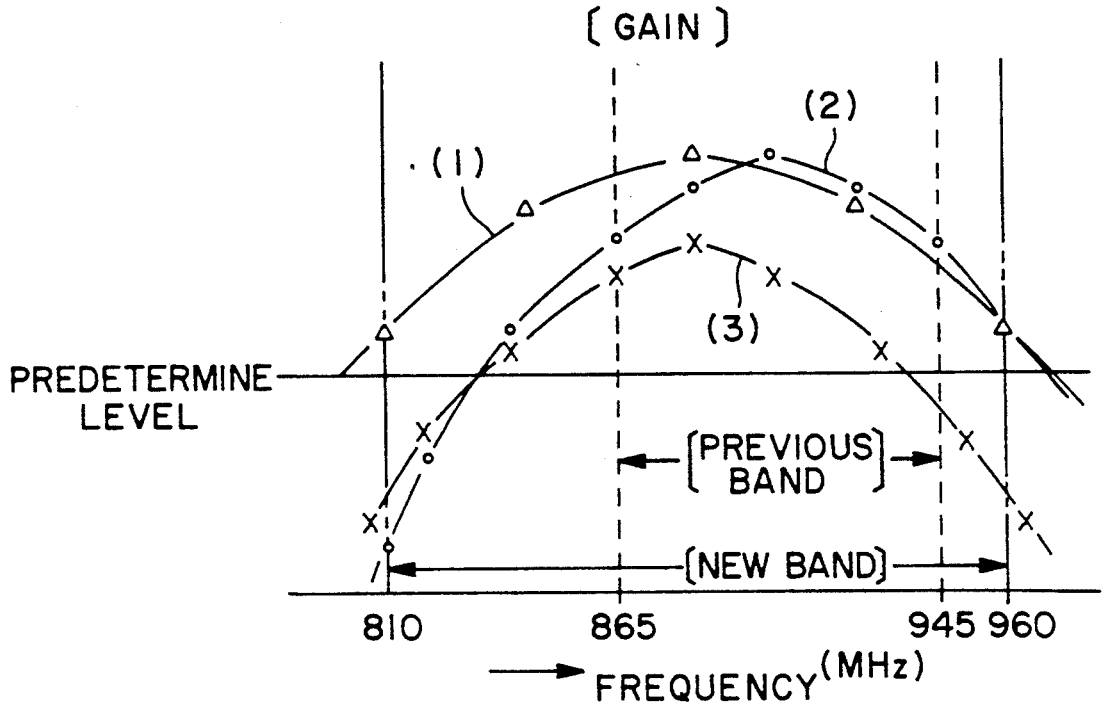
FIG. 4(*a*) is a graph which compares experimental data regarding the sensitivity characteristics of the antenna of the present invention and conventional antennas.
Figure 4B:
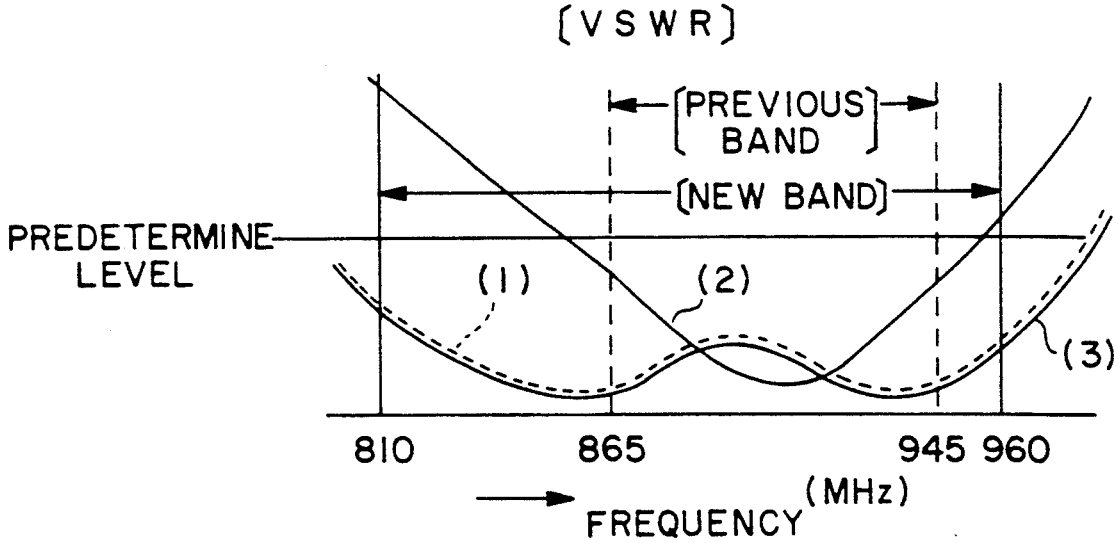

FIGS. 4(*a*) and 4(*b*), respectively, compare the experimental data concerning the sensitivity characteristics and the VSWR characteristics of the antenna of the embodiment of the present invention and conventional antennas.

In FIGS. 4(*a*) and 4(*b*), line (1) represents the characteristic curve of the antenna of the embodiment of the present invention, while lines (2) and (3) represent the characteristic curves of the "antenna with an electrical length of lambda/2" and the "antenna using a constant-K filter", respectively, described in the Prior Art section above.

It can be seen from these Figures that in the antenna of the embodiment of the present invention, the GAIN is above the predetermined level throughout the entire new frequency band of 810 MHz to 960 MHz, and thus high sensitivity characteristics are obtained. Furthermore, it also can be seen that the VSWR value is below the predetermined level (which is 1.7) through the entire new frequency band of 810 MHz to 960 MHz, thus showing broad band characteristics.

On the other hand, in the conventional antenna which has an electrical length of lambda/2 (shown by the line (2)), the GAIN and the VSWR values are within the predetermined limits in the old frequency band width of 80 MHz; however, for the new frequency band between 810 MHz and 960 MHz, the GAIN is out of the predetermined level on the lower side, and the VSWR value is also out of the predetermined level on both the higher and lower ends. The reason for this is that in the prior art antennas, the maximum value of the GAIN is limited to a range of 3 to 4 dBd for structural reasons. In another type of conventional antenna which uses low constant-K filter (shown by the line 3), the VSWR value is within the predetermined level throughout the entire new frequency band.

Figure 5:
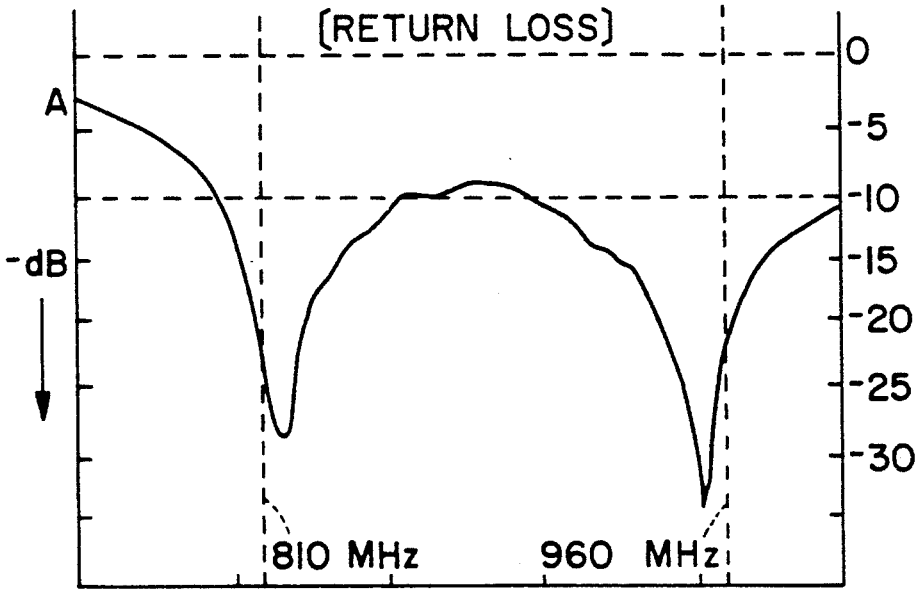
FIG. 5 is a graph which shows the return loss characteristics, which are seen from the feeder side and correspond to the VSWR shown in FIG. 4(*b*)

FIG. 5 shows the experimental data of the RETURN LOSS characteristics which is seen from the feeder side and corresponds to the VSWR characteristics shown in FIG. 4(*b*). As seen from FIG. 5, the lowest RETURN LOSS occurs at two points: one near 810 MHz frequency (reception side) and the other near 960 MHz frequency (transmission side). Thus, it is recognized that the characteristics are twin-peak characteristics obtained by double tuning.

Figure 6A:
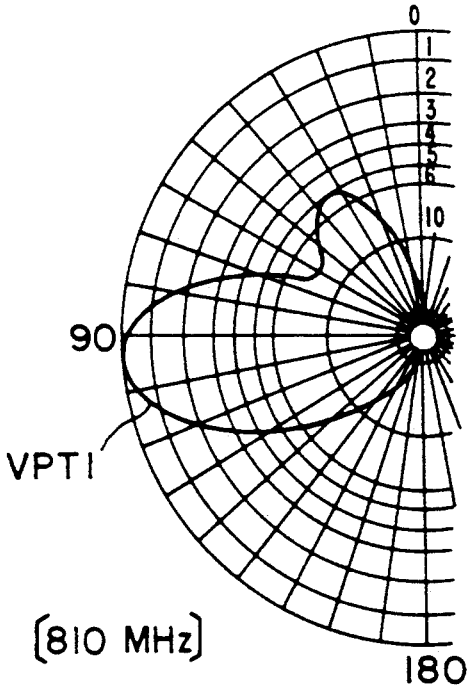
FIG. 6(*a*) is a diagram which shows the vertical-plane pattern of the antenna of the present invention at a frequency of 810 MHz.
Figure 6B:
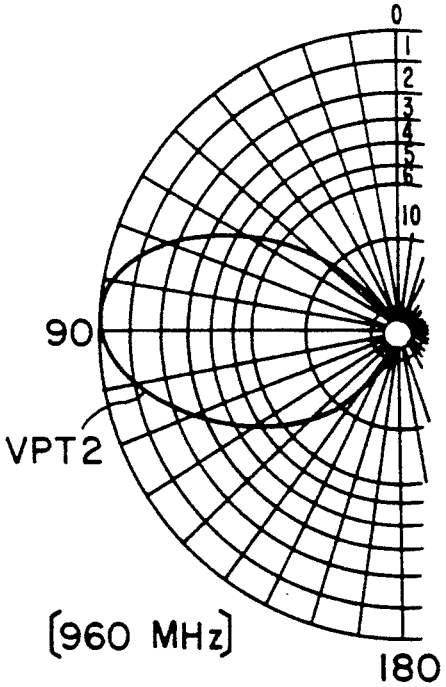

FIGS. 6(*a*) and 6(*b*) show the vertical-plane radiation patterns of the antenna of the embodiment of the present invention. FIG. 6(*a*) shows the vertical-plane radiation pattern (VPT1) at the frequency of 810 MHz, and FIG. 6(*b*) shows the vertical-plane radiation pattern (VPT2) at the frequency of 960 MHz. As seen from these Figures, the direction of maximum radiation is more or less horizontal in all directions.

Figure 7A:
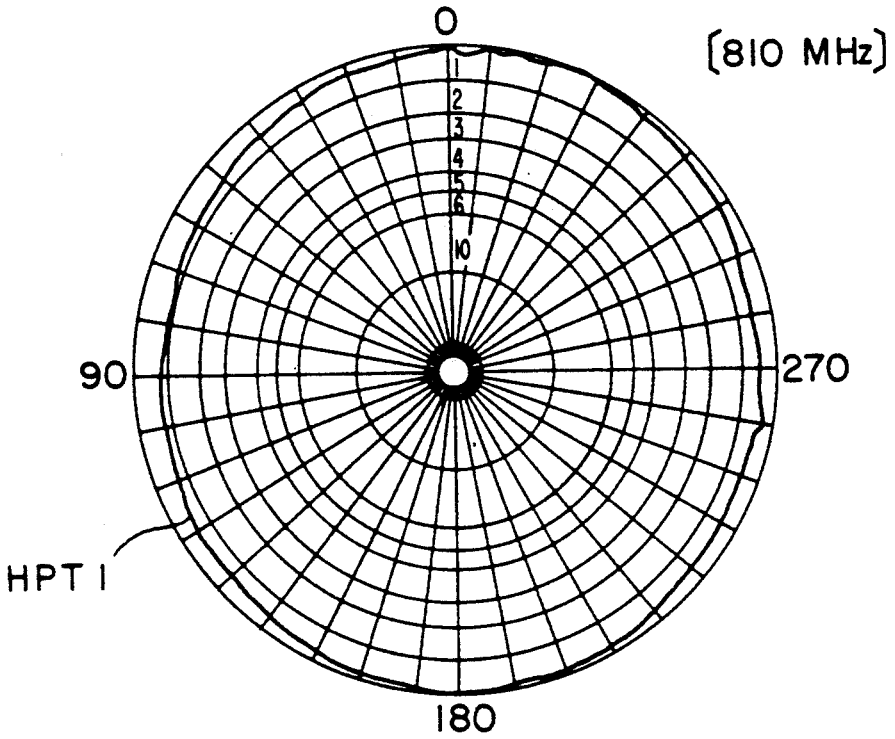
FIG. 7(*a*) is a diagram which shows the horizontal-plane radiation pattern of the antenna of the present invention at a frequency of 810 MHz.
Figure 7B:
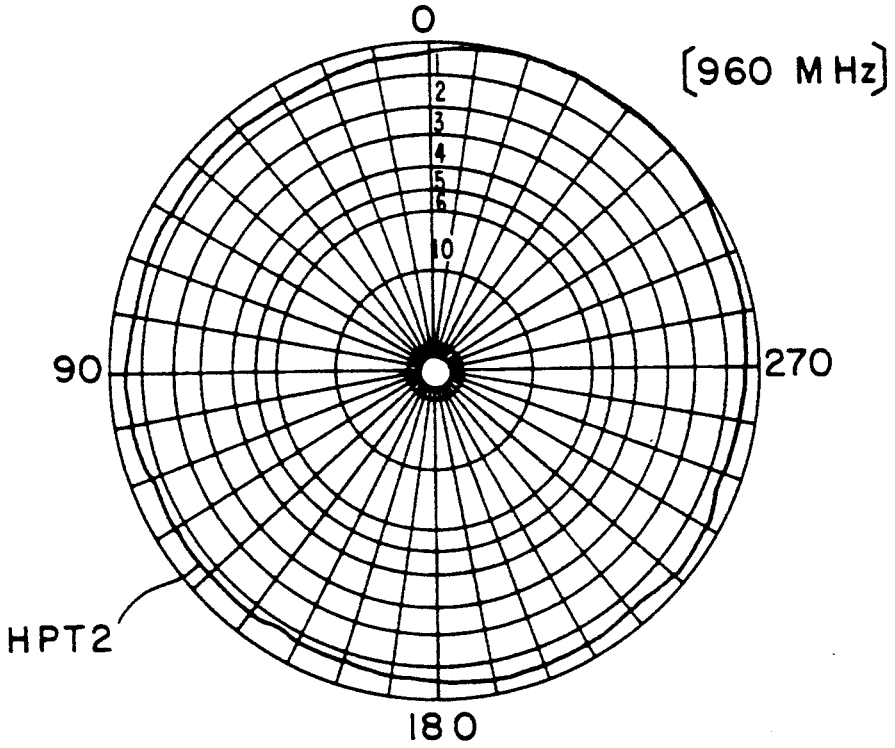

FIGS. 7(*a*) and 7(*b*) show the horizontal-plane radiation patterns of the antenna of the embodiment of the present invention. FIG. 7(*a*) shows the horizontal-plane radiation pattern (HPT1) at the frequency of 810 MHz, and FIG. 7(*b*) shows the horizontal-plane radiation pattern (HPT2) at the frequency of 960 MHz. In either FIG. 7(*a*) or FIG. 7(*b*), the deviation is within 1 dB which means that there is no influence of the electrostatic coupling piece 6.

The present invention is not limited to the embodiment described above. It goes without saying that various modifications are possible as long as there is no departure from the spirit of the present invention.

According to the present invention, the antenna element parallel resonance part and the metal member parallel resonance part are electrostatically coupled via the projecting electrostatic coupling piece, and as a result, a double-tuned circuit is created. Accordingly, the VSWR characteristics show a twin-peak pattern, and the VSWR characteristics which are sufficiently lower than the predetermined level are obtained throughout the entire frequency band, even in the new, expanded frequency band. Thus, it can meet the trend of the broader frequency band. Furthermore, the realization of the broader frequency band can be accomplished without shortening the antenna element, in other words, with the antenna element length kept at a prescribed value. As a result, the antenna GAIN can exceed the predetermined level for the entire frequency band, and sufficiently high sensitivity characteristics can be obtained.

As described above, the present invention provides a broad-band non-grounded type ultrashort-wave antenna which has sufficiently high sensitivity characteristics and broad-band VSWR characteristics even for the new, expanded frequency band width. In addition, according to the present invention, the antenna element can be of such a small-diameter as, for example, approximately 2 mm, light in weight, simple in structure and is manufactured inexpensively.

I claim:

1. A broad-band non-grounded type ultrashort-wave antenna comprising:

a rod-form antenna element which has an electrical length substantially equal to N·lambda/2 in which lambda is the wavelength of electromagnetic waves in a frequency band used and N is an integer equal to or greater than 1;

a first elongated metal member, said first elongated metal member being connected to a base end of said antenna element at another end thereof;

a second elongated metal member installed parallel to said first metal member with a predetermined space in between, a base section of said second elongated metal member being connected to a base section of said first metal member, said second metal member having an electrical length equal to lambda/4;

a coaxial cable having a central conductor thereof connected to said first metal member at substantially said connection between said first and second metal members;

and elongated electrostatic coupling piece projecting from another end of said second metal member so that a stray capacity is created between said electrostatic coupling piece and said antenna element, said electrostatic coupling piece being narrower than either said first or second metal members; and a means for varying a surface area of said electrostatic coupling piece; and wherein an antenna element parallel resonance part formed by an inductance and a distributed capacitance of said antenna element, and a metal member parallel resonance part formed by an inductance of said first metal member and an electrostatic capacitance between said first and second metal members, are electrostatically coupled via said stray capacity which is present between said electrostatic coupling piece and said antenna element, thus forming a double tuned circuit.

2. A broad band non-grounded type ultrashort-wave antenna according to claim 1 wherein said means for varying a surface area of said electrostatic coupling piece comprises a slider.

* * * * *